US011261823B2

(12) United States Patent
Mastonstråle

(10) Patent No.: US 11,261,823 B2
(45) Date of Patent: Mar. 1, 2022

(54) STIRLING ENGINE ARRANGED WITH A GAS CHANNEL INCLUDING THREE HEAT EXCHANGERS

(71) Applicant: Maston AB, Älvkarleby (SE)

(72) Inventor: Stefan Mastonstråle, Älvkarleby (SE)

(73) Assignee: Maston AB, Älvkarleby (SE)

( * ) Notice: Subject to any disclaimer, the term of this patent is extended or adjusted under 35 U.S.C. 154(b) by 0 days.

(21) Appl. No.: 16/959,290

(22) PCT Filed: Dec. 20, 2018

(86) PCT No.: PCT/SE2018/051351
§ 371 (c)(1),
(2) Date: Jun. 30, 2020

(87) PCT Pub. No.: WO2019/135694
PCT Pub. Date: Jul. 11, 2019

(65) Prior Publication Data

US 2021/0054807 A1 Feb. 25, 2021

(30) Foreign Application Priority Data

Jan. 2, 2018 (SE) ..... 1850005-8

(51) Int. Cl.
*F02G 1/055* (2006.01)
*F02G 1/057* (2006.01)
(Continued)

(52) U.S. Cl.
CPC ..... *F02G 1/055* (2013.01); *F02G 1/043* (2013.01); *F02G 1/053* (2013.01); *F02G 1/057* (2013.01);
(Continued)

(58) Field of Classification Search
CPC ..... F02G 1/00–06
See application file for complete search history.

(56) References Cited

U.S. PATENT DOCUMENTS 4,969,333 A 11/1990 Osawa et al.
5,417,066 A * 5/1995 Kawano ..... F02G 1/043 60/517
(Continued)

FOREIGN PATENT DOCUMENTS

EP 1239137 A2 9/2002
GB 2105787 A * 3/1983 ..... F02B 29/00
(Continued)

OTHER PUBLICATIONS

International Search Report for the application No. PCT/SE2018/051351, dated Feb. 14, 2019 in 4 pages.
(Continued)

*Primary Examiner* — Laert Dounis
(74) *Attorney, Agent, or Firm* — Knobbe, Martens, Olson & Bear, LLP

(57) ABSTRACT

A Stirling engine includes a working cylinder defining a working cylinder chamber with a reciprocatingly-arranged working piston and a heater fluidly communicating with the working cylinder chamber through a working gas channel. The engine includes a first heat exchanger extending from a head of a displacer cylinder into the heater, a second heat exchanger formed by a regenerator arranged outside the heater, and a third heat exchanger formed by a cooler arranged between the regenerator and the working cylinder chamber. At any point along the working gas channel, as seen cross-wise to an assumed working gas flow direction through the working gas channel, the cross section area of the working gas channel defined by the first, second and third heat exchangers is within the range of the medium cross section area of the working gas channel +/−10%.

16 Claims, 11 Drawing Sheets

(51) Int. Cl.
*F02G 1/043* (2006.01)
*F02G 1/053* (2006.01)

(52) U.S. Cl.
CPC ..... *F02G 2243/02* (2013.01); *F02G 2243/30* (2013.01); *F02G 2270/45* (2013.01); *F02G 2270/85* (2013.01)

(56) References Cited

U.S. PATENT DOCUMENTS

| | | | |
|---|---|---|---|
| 5,435,140 | A | 7/1995 | Ishino et al. |
| 5,522,722 | A | 6/1996 | Kwon |
| 5,749,226 | A | 5/1998 | Bowman et al. |
| 6,931,848 | B2 | 8/2005 | Maceda et al. |

FOREIGN PATENT DOCUMENTS

| | | | | | |
|---|---|---|---|---|---|
| GB | 2290351 | A | * | 12/1995 | ..... F02G 1/0435 |
| JP | 05-52661 | U | | 7/1993 | |
| JP | H07293334 | A | * | 11/1995 | |
| JP | 09-152211 | A | | 6/1997 | |

OTHER PUBLICATIONS

Indian Examination Report for Indian Patent Application No. 202047032535, dated Jan. 29, 2021 in 5 pages.

* cited by examiner

STIRLING ENGINE ARRANGED WITH A GAS CHANNEL INCLUDING THREE HEAT EXCHANGERS

CROSS-REFERENCE TO RELATED APPLICATIONS

This application is the U.S. National Phase under 35. U.S.C. § 371 of International Application PCT/SE2018/051351, filed Dec. 20, 2018, which claims priority to Swedish Patent Application No. 1850005-8, filed Jan. 2, 2018. The disclosures of the above-described applications are hereby incorporated by reference in their entirety.

TECHNICAL FIELD

The present invention relates to a Stirling engine comprising:

- a crank case with a crank shaft arranged therein,
- a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston,
- a working cylinder defining a working cylinder chamber with a reciprocatingly arranged working piston therein, said working piston being connected to said crank shaft via a connecting rod extending through a first end of the working cylinder,
- a heater device, arranged at a second end of said displacer cylinder opposite to said first end and configured to heat a working gas in which is present in the hot chamber of the displacer cylinder and in fluid communication with the working cylinder chamber through a working gas channel which comprises
- a first heat exchanger extending from a cylinder head of the displacer cylinder into the heater device,
- a second heat exchanger formed by a regenerator arranged outside the heater device, and
- a third heat exchanger formed by a cooler arranged between the regenerator and the working cylinder chamber.

A regenerator is referred to as an internal heat exchanger and temporary heat store placed between the hot chamber of the displacer cylinder and the working cylinder such that the working fluid passes through it first in one direction then the other, taking heat from the fluid in one direction, and returning it in the other. It can be as simple as metal mesh or foam, and benefits from high surface area, high heat capacity, low conductivity and low flow friction. Its function is to retain within the system the heat that would otherwise be exchanged with the environment at temperatures intermediate to the maximum and minimum cycle temperatures.

BACKGROUND ART

External combustion engines of Stirling type are well known. They may be of three different types, which are named alpha, beta and gamma and differ from each other with regard to how the displacer cylinder, working cylinder and the displacer piston and the working piston are arranged in relation to each other and to the crank shaft that is driven by the working piston.

Essential to the function of a Stirling engine is that a working medium is heated by a heater device, preferably by a burner flame in a combustion chamber. During heating thereof, the working gas is conducted through a heat exchanger that may comprise one or more tubes that extend from the hot chamber of the displacer cylinder into the combustion chamber, out of the combustion chamber and towards a regenerator. The regenerator is located outside the combustion chamber and is the individual component that distinguishes Stirling engines from other types of external combustion engines, after the regenerator, as seen in a flow direction of the working gas from the hot chamber of the displacer cylinder to the working cylinder, there may also be provided a cooler.

Accordingly there is provided a channel, comprising the individual channels of the heat exchanger, the regenerator and the cooler, through which the working medium is moved back and forth between the displacer cylinder and the working cylinder during the operation of the engine. Said channel also comprises transition flow elements that are provided between and that interconnect the heat exchanger and the regenerator and the regenerator and the cooler, and that are arranged between the cooler and the working cylinder. One of the big challenges when designing a functioning Stirling engine is to minimize the flow losses in the working gas channel.

SUMMARY OF THE INVENTION

It is an object the present invention to present an alternative working gas channel design that combines heat exchange efficiency, including heat regeneration efficiency, with very low flow losses caused by unfavourable flow behaviour of the working gas.

The object of the present invention is achieved by means of the initially defined Stirling engine, which is characterised in that, at any point along the working gas channel, as seen cross wise to an assumed working gas flow direction through the working gas channel, the cross section area of the working gas channel defined by the first, second and third heat exchangers is within the range of the medium cross section area of the working gas channel +/−10%. Tests made by the applicant have shown that reduced variations in the cross-sectional area of the working gas channel will result in less dead volume and in less delay effects. With a substantially constant cross-sectional area, the working gas flow will tend be more laminar and less turbulent due to changes in cross-sectional area, and this is assumed to contribute to a reduction of flow losses.

According to an aspect, the Stirling engine is characterised in that, at any point along the working gas channel, as seen cross wise to an assumed working gas flow direction through the working gas channel, the cross section area of the working gas channel defined by the first, second and third heat exchangers is within the range of the medium cross section area of the working gas channel +/−5%.

According to one example, along at least 95%, preferably 99%, of the total length of the working gas channel, the cross section area of the working gas channel is within the range of the medium cross section area of the working gas channel +/−10%, preferably +/−5%.

According to one example, the first heat exchanger comprises a plurality of tubes, wherein the cross-section area of said working gas channel at any predetermined point along the tubes is the total cross-section area of the individual channels at that point along the channels defined by the tubes. Preferably, the tubes have the same length +/−10%, preferably +/−5%.

According to one example, the regenerator comprises a regenerator element that has an annular body of metal foam.

The annular body may be arranged around the outer periphery of the displacer cylinder and is enclosed in an outer ring or cylinder that is gas sealingly arranged on the outer periphery of the regenerator element. According to one example, the metal foam is a Nickel Chromium alloy (NiCr). Metal foam has the advantage of not being compressed when subjected to the pressures and pressure changes in the Stirling engine, as would a fibre-based body be. If a regenerator body is compressed due to the changing pressures that it is subjected to, the cross-sectional area of the channels defined therein is reduced since the density of the body is increased. Accordingly, the use of metal foam contributes to less flow losses due to changes of the cross-sectional area upon operation of the Stirling engine.

According to one example, the third heat exchanger comprises a tubular metallic body provided with a plurality of first channels extending through said metallic body for the conducting of the working gas and at least one second cooling channel for the conducting of a cooling fluid through said cooling channel. The third heat exchanger may be defined as a cooler, configured for active cooling of the working gas flowing through it upon operation of the Stirling engine.

According to one example, the Stirling engine comprises a first transition flow element provided between and connecting the first heat exchanger with the second heat exchanger, wherein said first transition flow element comprises a plurality of channels that each has an inlet having a shape and cross sectional area corresponding to the shape and cross-sectional area of the channel of a tube of the first heat exchanger to which it is connected, and an outlet opening facing said second heat exchanger, and that along at least 75%, preferably 90%, of the length thereof the channels of the transition flow element have a total cross sectional area along which is within the range of the medium cross section area of the working gas channel +/−10%, preferably with the range of +/−5% of said medium cross section area. At the end of each of said channels that is adjacent the second heat exchanger, the cross-section increases such that the total cross sectional area of the openings thereof is generally equal to the total cross-sectional area of the second heat exchanger, as seen cross-wise to the assumed flow direction of the working gas.

According to one example, the cooler comprises a plurality of tubes that each define a channel, wherein the Stirling engine comprises an intermediate element provided between and connecting the second heat exchanger with the third heat exchanger, wherein said intermediate element comprises a plurality of channels that each has an outlet having a shape and cross sectional area corresponding to the shape and cross-sectional area of the channel of a tube of the third heat exchanger to which it is connected, and an inlet opening facing said second heat exchanger, and that along at least 75%, preferably at least 90%, of the length thereof the channels of the transition flow element have a total cross sectional area which is within the range of the medium cross section area of the working gas channel +/−10%. At the end of each of said channels that is adjacent the second heat exchanger, the cross-section increases such that the total cross sectional area of the openings thereof is equal to the total cross-sectional area of the second heat exchanger, as seen cross-wise to the assumed flow direction of the working gas. Thereby, working gas flowing from the working cylinder towards the displacer cylinder in said working gas channel will be prevented from flowing as jet streams through the regenerator as it leaves the cooler. The invention also comprises examples in which the intermediate element is refrained from, wherein an end of the regenerator faces the cooler without any such intermediate element therebetween.

According to one aspect, the Stirling engine comprises a second transition flow element provided between the third heat exchanger and the working cylinder, and that, at any point along the length thereof, the second transition flow element has a total cross sectional area which is within the range of the medium cross section area of the working gas channel +/−10%, preferably within the range of the medium cross section area of the working gas channel +/−5%. According to one aspect, the second transition flow element comprises a tube that defines a single channel that defines part of the working gas channel. According to one aspect, said channel forms at least 90%, preferably at least 95% of the length of the working flow gas channel between the third heat exchanger and the working cylinder.

According to one aspect, the second transition flow element is provided with an flow control element configured to control the cross-sectional area of the channel defined by the second transition flow element, and wherein the cross-sectional area of the working gas channel, at any point along said channel defined by the second transition flow element, is within the range of the medium cross-sectional area of the working gas channel +/−10% when the flow control element is in a position in which it allows maximum passage of working gas.

According to one aspect, the working gas flow control element comprises a flexible tube filled with a gas which is located in a channel defined by second transition flow element. The working gas flow control element may also be defined as a volume control element that controls the volume available for the working gas inside the second transition flow element. As, during operation of the engine, the working piston approaches its upper dead point, the working gas pressure is reduced in the channel defined by the second transition flow element. The working gas flow element thereby expands as a result of its inner gas pressure and fills the channel defined by the second transition flow element. A dead volume occupied by working gas inside the second transition flow element is thereby avoided.

According to one aspect the working gas channel is comprised by the channels defined by the following components (with percentage of total length of working gas channel):

channel defined by each tube of first heat exchanger: 25-50%
channel defined by first transition flow element: 2-10%
channel defined by second heat exchanger: 2-10%
channel defined by third heat exchanger: 5-15%
channel defined by second transition flow element: 20-40%
collecting element between third heat exchanger and second transition flow element: <1%

Additional objectives, advantages and novel features of the invention will be apparent to one skilled in the art from the following details, and through exercising the invention. While the invention is described below, it should be apparent that the invention may not be limited to the specifically described details. One skilled in the art, having access to the teachings herein, will recognize additional applications, modifications and incorporations in other areas, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various diagrams, and in which.

DETAILED DESCRIPTION

Figure 1:
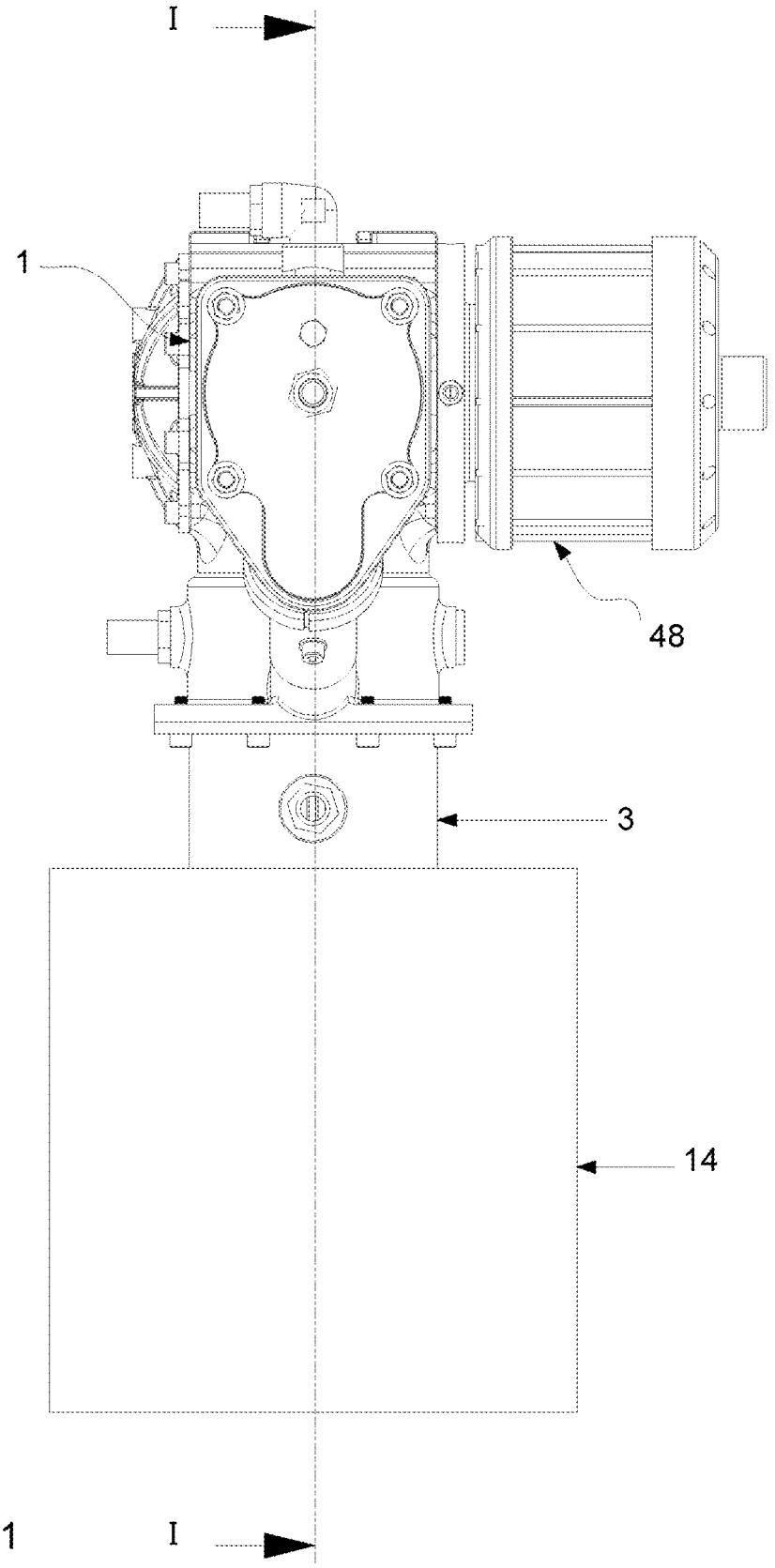
FIG. 1 is a view from above of a Stirling engine according to the invention provided with a schematically shown heater device.
Figure 2:
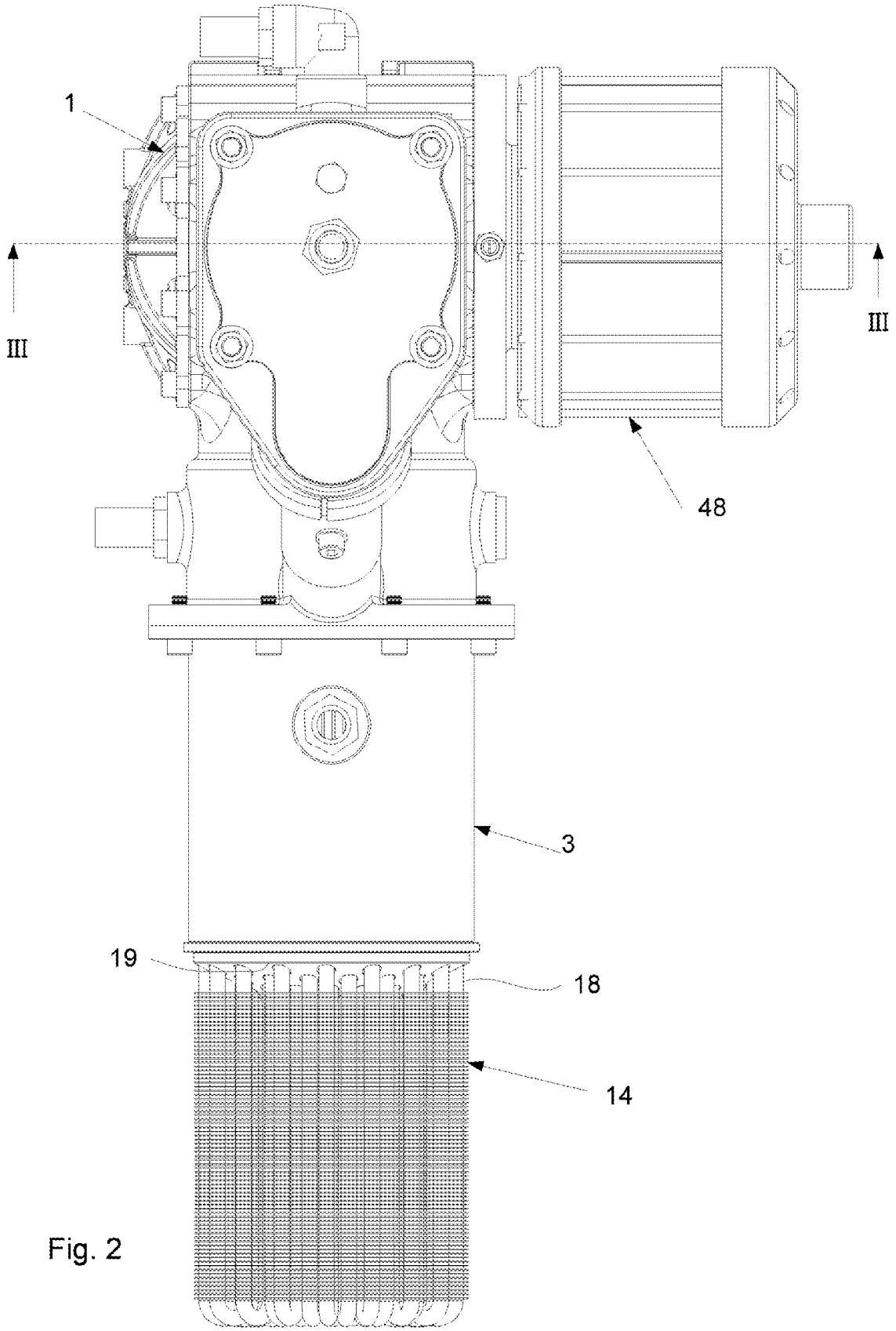
FIG. 2 is a view corresponding to FIG. 1, but with the heater device removed from the rest of the engine.
Figure 3:
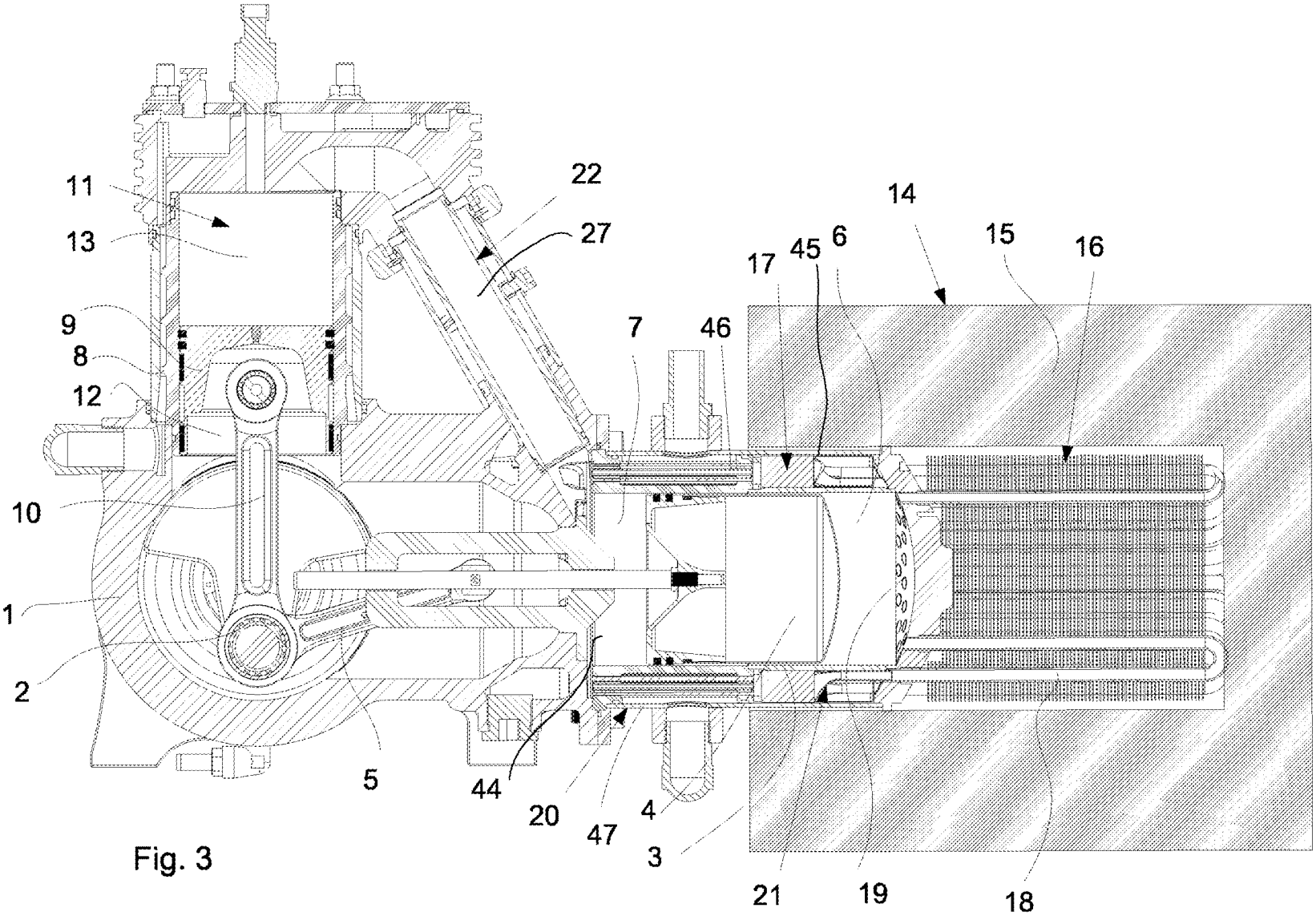
FIG. 3 is a cross-section according to in FIG. 1, still with the heater device shown schematically.
Figure 4:
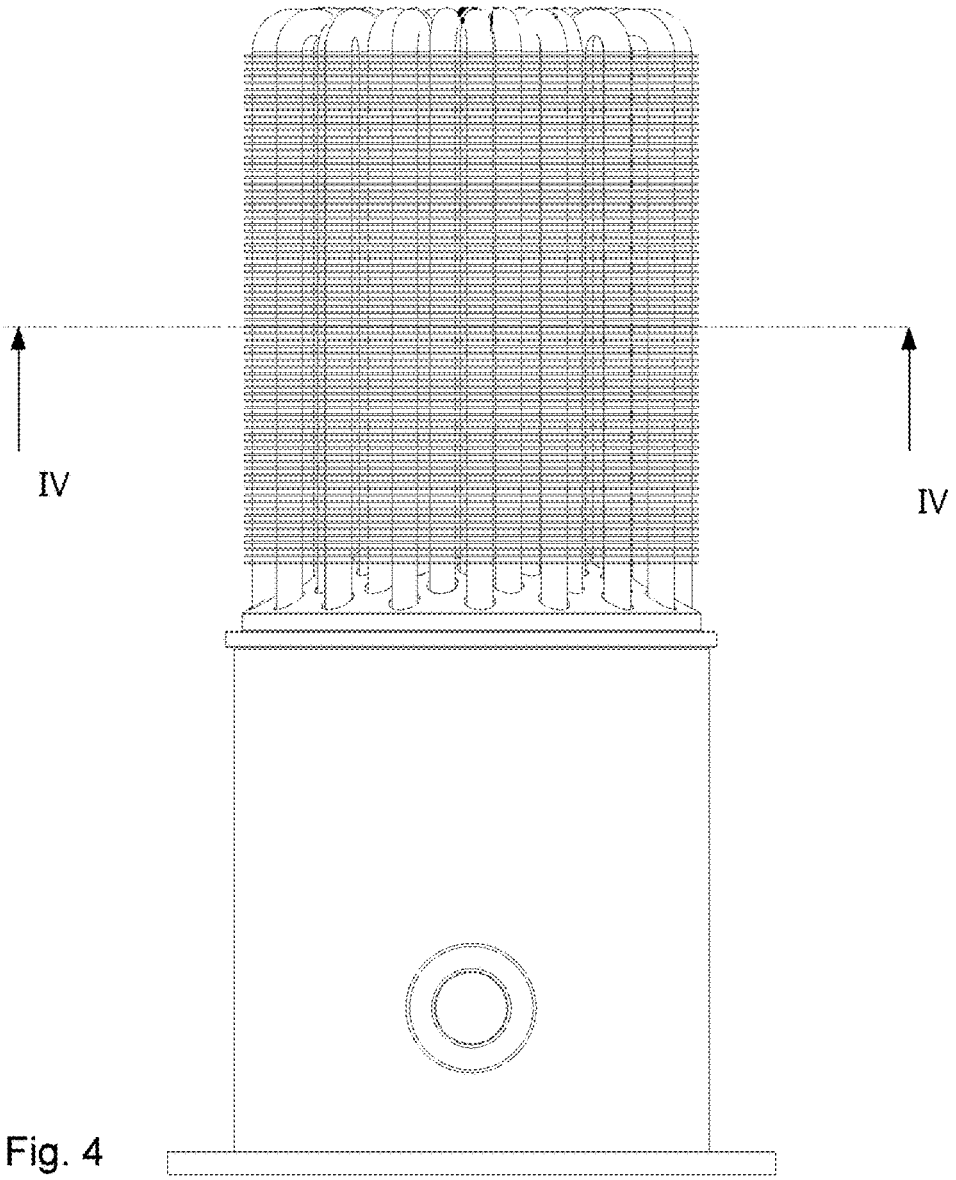
FIG. 4 is a side view of a part of the Stirling engine shown in FIGS. 1-3 showing a first heat exchanger thereof.

FIGS. 1-3 show an example of a Stirling engine according to the present invention. The Stirling engine shown is of gamma type and comprises a crank case 1 with a crank shaft 2 arranged therein, and a displacer cylinder 3 with a reciprocatingly arranged displacer piston 4 therein. The displacer piston 4 is connected to the crank shaft 2 via a connecting rod 5 extending through a first end of said displacer cylinder 3. During operation of the Stirling engine, the displacer cylinder 3 defines a hot chamber 6 and a cool chamber 7 separated by the displacer piston 4.

The Stirling engine further comprises a working cylinder 8 with a reciprocatingly arranged working piston 9 therein, said working piston 9 being connected to the crank shaft 2 via a connecting rod 10 extending through a first end of the working cylinder 8. A working cylinder chamber 11 defined by the working cylinder 8 is divided by the working piston 9 into a first part 12, through which said connecting rod 10 extends, and a second part 13 configured to house a working gas during operation of the Stirling engine. The second part 13 of the working cylinder chamber 11 is in fluid communication with the hot chamber 6 of the displacer cylinder 3 for the transportation of the working gas between said second part 13 of the working chamber 11 and the hot chamber 6 of the displacer cylinder 3 during operation of the engine.

To the crank shaft 2 there is connected an electric generator 48, via which electric power can be transferred from the Stirling engine.

A heater device 14 is arranged at a second end of the displacer cylinder opposite to said first end and configured to heat a working gas which is present in the hot chamber 6 of the displacer cylinder 3 and which is in fluid communication with the second part 13 of the working cylinder chamber 11. In the example shown the heater device 14 comprises a combustion chamber 15 which is arranged at the second end of said displacer cylinder 3 opposite to said first end.

Furthermore, the Stirling engine comprises a first heat exchanger 16 and a second heat exchanger 17. The first heat exchanger 16 comprises plurality of tubes 18 that extend from a displacer cylinder head 19 provided at said second end of the displacer cylinder 3 into the combustion chamber 15 and out of the combustion chamber 15 to the second heat exchanger 17. The second heat exchanger 17 is comprised by a regenerator provided outside the combustion chamber 15 and outside the displacer cylinder 3. In the example shown the engine also comprises a third heat exchanger 20 formed by a cooler arranged between the regenerator 17 and the working cylinder chamber 11, a first transition flow element 21 provided between said first and second heat exchangers 16, 17, and a second transition flow element 22 provided between the third heat exchanger 20 and the working cylinder 8. The cooler 20 comprises a body with channels 46 for the conduction of the working gas therethrough and with further channels 47 which form part of a cooling medium circuit.

The hot chamber 6 defined by the displacer cylinder 3 is in fluid communication with a second end, i.e. the above-defined second part 13, of the working cylinder chamber 11 through a channel comprising the first heat exchanger 16, the second heat exchanger 17, the third heat exchanger 20, the first transition flow element 21 and the second transition flow element 22. Though not shown in this example, there may also be provided an intermediate flow element between the second and third heat exchangers 17, 20, wherein such an intermediate element has a design corresponding to the design of the first transition flow element.

Figure 5:
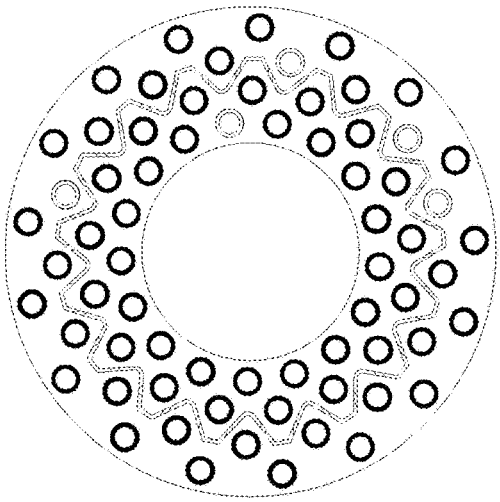
FIG. 5 is a cross-section along IV-IV in FIG. 4.

Each tube 18 of the first heat exchanger, defines a channel that has a cross-section which is constant along the whole length of the tube 18. The tubes 18 form a pattern that is shown in FIG. 5, which shows a cross section in which the tubes 18 going out from the displacer cylinder head 19 forms an inner set of tubes, and the same tubes, after a 180 degree bend, form an outer set of tubes that are directed towards the second heat exchanger 17, which is a tubular body of a metal foam clamped between the outer periphery of the displacer cylinder 3 and a further outer cylinder 45 (see FIGS. 3, 5 and 6). The metal foam of the second heat exchanger has an open porosity that defines a channel for passage of the working gas. The cross-sectional area of the channel defined by the pores of the second heat exchanger 17 corresponds to the sum of the cross-sectional areas of the channels defined by the tubes 18. The metal foam of the second heat exchanger may comprise any metal or alloy suitable for the purpose, preferably a Ni—Cr alloy.

The tubes 18 of the first heat exchanger 16 extend to the region of an end wall of the heater device 14 arranged on the outer periphery of the displacer cylinder 3. The second heat exchanger 17 is located outside the heater device 14 in the respect that it is located outside the combustion chamber 15 defined by the heater device 14.

Figure 7:
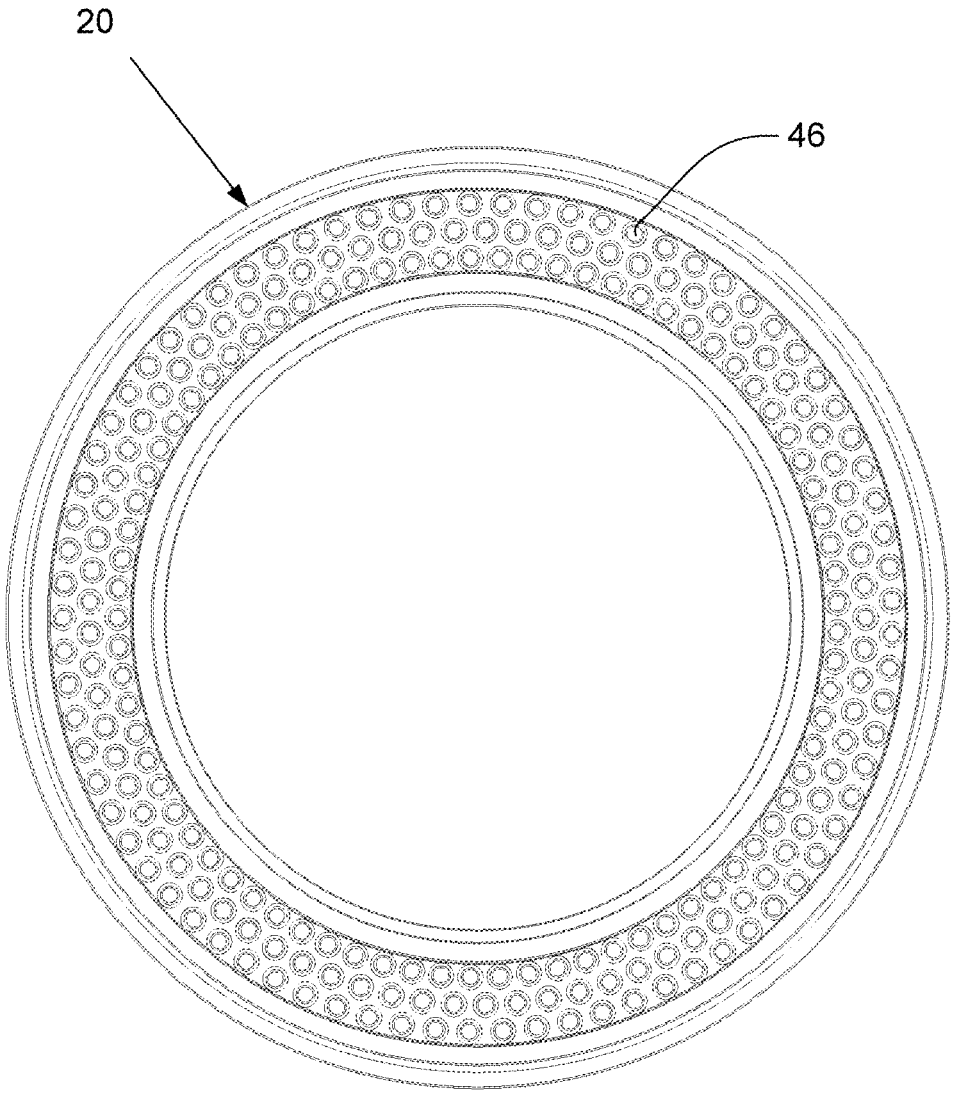
FIG. 7 is a cross-section through a third heat exchanger of the Stirling engine shown in FIGS. 1-3.
Figure 8:
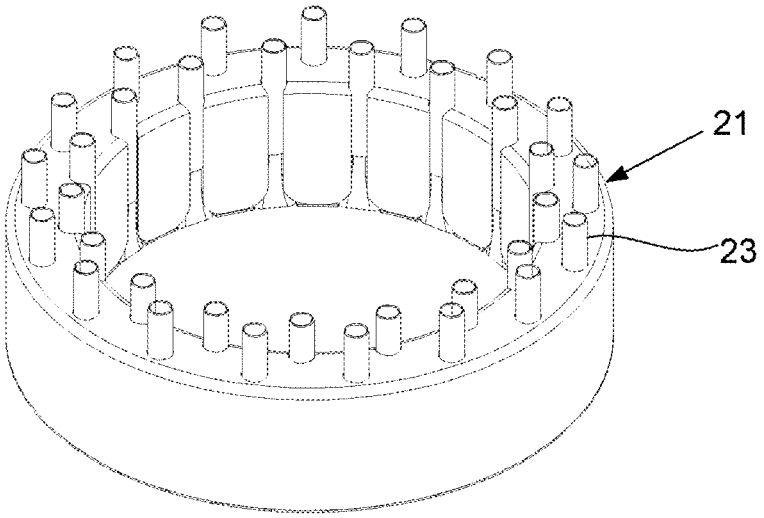
FIG. 8 is a perspective view of a first transition flow element.
Figure 9:
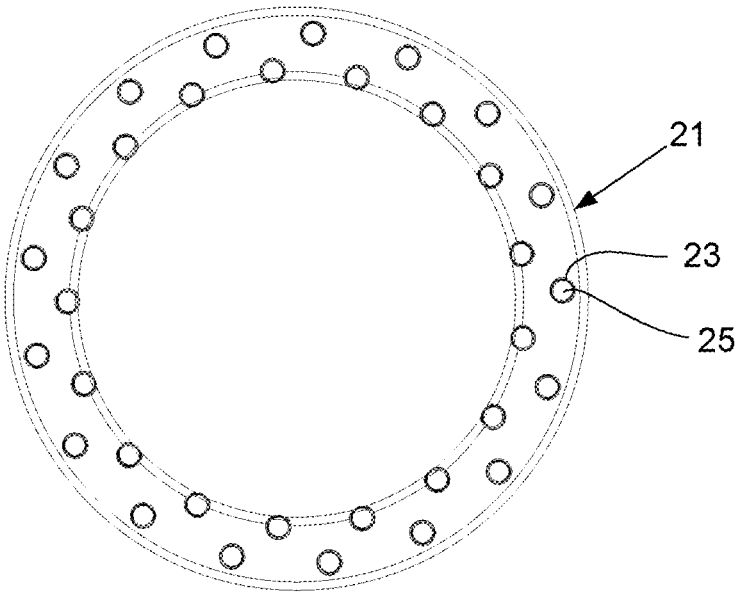
FIG. 9 is an end view of the first transition flow element shown in FIG. 8.
Figure 10:
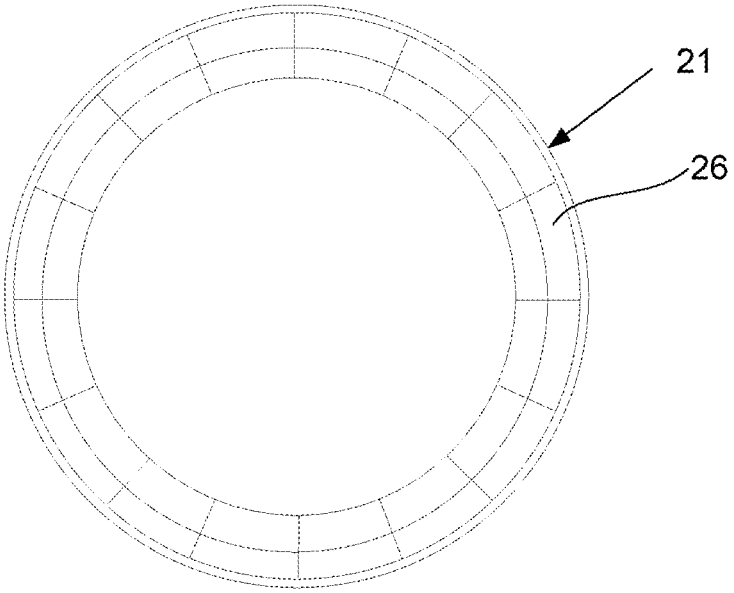
FIG. 10 is an end view from the opposite end of the transition flow element shown in FIG. 9.
Figure 11:
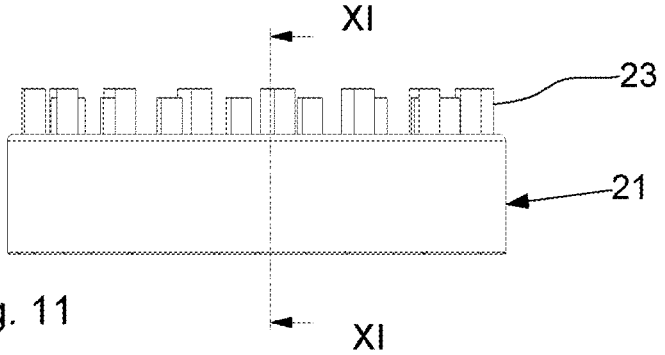
FIG. 11 is a side view of the transition flow element shown in FIG. 9.
Figure 12:
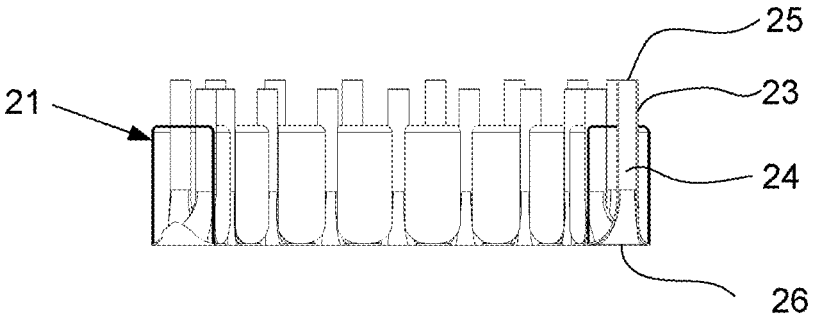
FIG. 12 is a cross-section according to XI-XI in FIG. 11.
Figure 13:
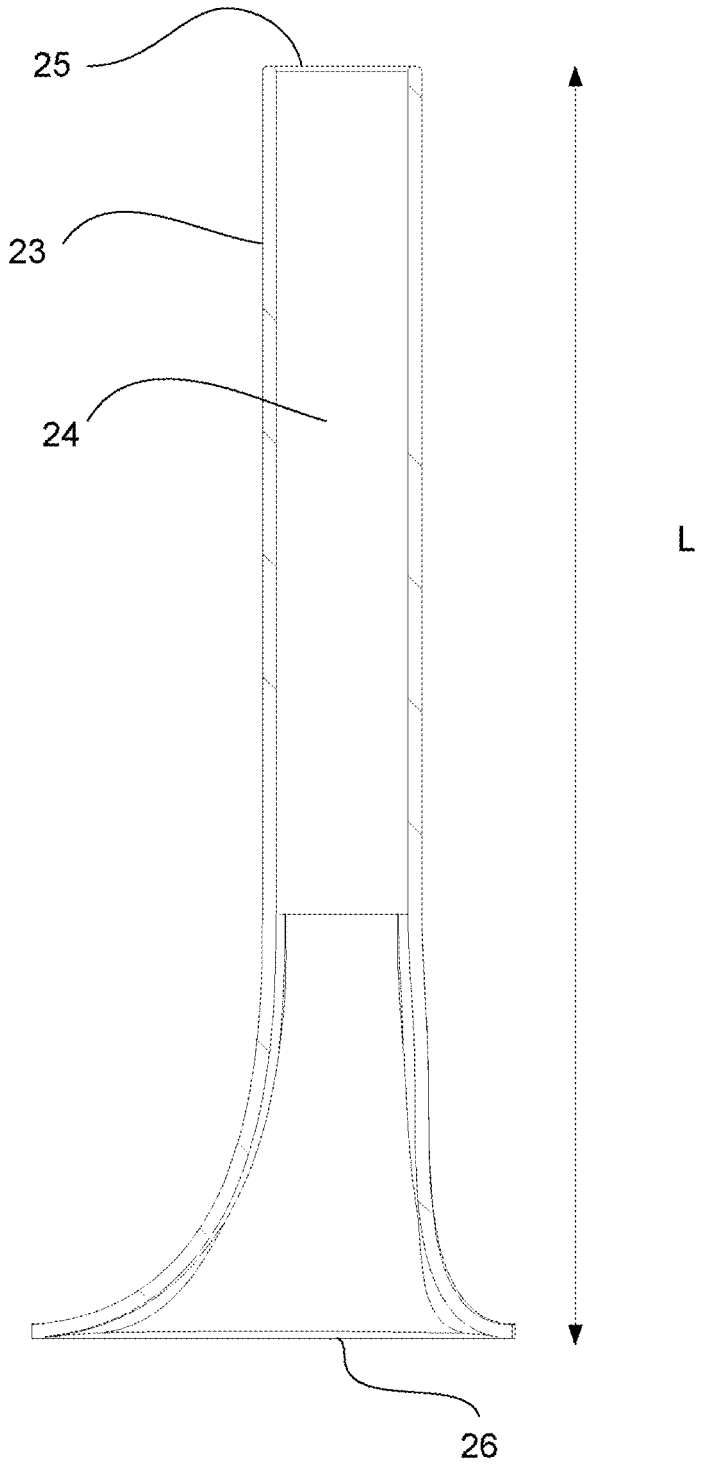
FIG. 13 is an enlarged view of a part of the transition element shown in FIG. 12.

On the opposite side of the second heat exchanger 17, the third heat exchanger 20 is arranged. The third heat exchanger 20 comprises a tubular metallic body provided with a plurality of first channels 46 extending therethrough for the conducting of the working gas and at least one second cooling channel 47 for the conducting of a cooling fluid therethrough. FIG. 7 shows a part of the third heat exchanger 20 that comprises said channels 46 for the working gas flow. The number of channels 46 is considerably higher (at least 50% higher) than the number of channels defined by the tubes 18 of the first heat exchanger 16. However the total cross-sectional area of the channels 46 defined by the third heat exchanger 20 corresponds to the total cross sectional area of the channels defined by the tubes 18 of the first heat exchanger 16. The cross-sectional area of each of the channels 46 of the third heat exchanger is constant along the whole length thereof. In the example shown, the third heat exchanger 20 is immediately clamped towards the end of the second heat exchanger 17 that it faces.

Between the ends of the tubes 18 of the first heat exchanger 16 and the end of the second heat exchanger 17 that faces said ends there is provided the first transition element flow element 21. Reference is made to FIGS. 8-13, which show the first transition flow element 21 more in detail. The transition flow element 21 comprises an annular body in which there is provided plurality of inserts 23. Each insert 23 extend through the annular body in the direction of the centre axis of the annular body. In each insert 23 there is provided a channel 24 which extends in the direction of the centre axis of the tubular element and thereby defines a channel 24 through the annular body of the transition flow element 21.

Figure 6:
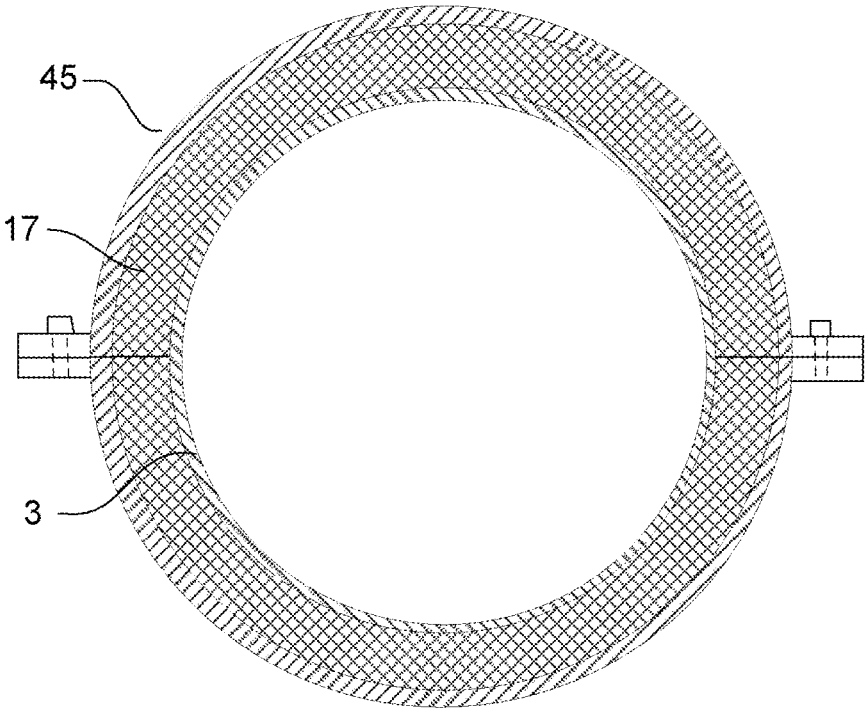
FIG. 6 is a cross section through the second heat exchanger of the Stirling engine shown in FIGS. 1-3.

In one end of each of the channels 24, that faces and is connected to a corresponding opposite end of a tube 18 of the first heat exchanger, the channel 24 defines an inlet opening 25. The inlet opening 25 has geometry and cross sectional area corresponding to the geometry and cross sectional area of the cross section of the channel defined by the tube 18. In the opposite end of each channel 24, the channel 24 defines an outlet opening 26. The outlet opening 26 is larger than the inlet opening 25. The outlet openings 26 have tetrahedral shape and are arranged in pairs covering a respective sector of the annular end face of the transition flow element, as is shown in FIG. 6.

Along approximately 80% of the length of each channel 24, the channel has geometry and a cross sectional area corresponding to the geometry and cross sectional area of the inlet opening 25. Along the remaining approximately 10% of the length of the channel 24, the channel widens to the geometry and cross sectional area of the outlet opening 26. The curvature of the widening of the channel 24 is adapted to the expected flow characteristics of the working gas, so that the flow of working gas through the widening part of the channel 24 will be in accordance with the Coanda effect. The Coanda effect is defined as the phenomena in which a jet flow attaches itself to a nearby surface and remains attached even when the surface curves away from the initial jet direction. The part of each channel 24 that is widened only occupies less than 1%, preferably less than 0.5%, of the total length of the working gas channel, and therefore only has a minor effect on the flow losses.

The outlet openings 26 of the channels 24 of the transition flow element are distributed over a face of the first transition flow element 21 that confronts an annular end face of the regenerator element 17. An intermediate flow element, corresponding to the first transition flow element 21, could possibly be arranged between the second heat exchanger 17 and the third heat exchanger 20. In such a case, the number of channels defined by the intermediate element should correspond to the number of channels 46 in the third heat exchanger, and the inlet openings of the intermediate element should be connected to a respective of said channels 46 of the third heat exchanger 20.

The second transition flow element 22 comprises a tubular body that extends from the region of an end of the third heat exchanger 20 to the second part 13 of the working cylinder chamber 11. The second transition flow element 22 defines a channel 27 through which the working gas is able of flowing from the region of the end of the third heat exchanger 20 to the working cylinder chamber. Said channel 27 has a cross-sectional area which corresponds to the total cross-sectional area of the channels 46 defined by the third heat exchanger, and also to the cross-sectional area defined by the channels defined by the second heat exchanger 17 and the total cross-sectional area of the channels defined by the tubes 18 of the first heat exchanger 16.

FIGS. 14-17 show an alternative example in which the there is provided a flow control element 28 configured to control the volume available to the working gas in said channel 27 defined by the second transition flow element 22 depending on the working gas pressure in said channel 27. The flow control element 28 comprises a collapsible body 29 filled with a gas.

The collapsible body 29 has the shape of a tube having a longitudinal axis which is coaxial with a longitudinal axis of the channel 27 in which it is located. The flow control element 28 also comprises a non-flexible tube 30 which is provided in the centre of the collapsible body 29, and coaxially therewith. The non-flexible tube 30 is rigid enough to withstand an outer pressure from the collapsible body 29 caused by the gas pressure in the latter without collapsing. The non-flexible tube 30 guarantees that there will be a conduit for working gas to flow through from the working cylinder 8 towards the displacer cylinder 3 in said channel 27 irrespectively of how much the collapsible body 29 expands and fills the channel 27 in which it is located. The non-flexible tube 30 is held in position by a holder element 31 that in one end is connected to the tubular body of the transition flow element 22 and in another end is connected to the non-flexible tube 30.

Figure 14:
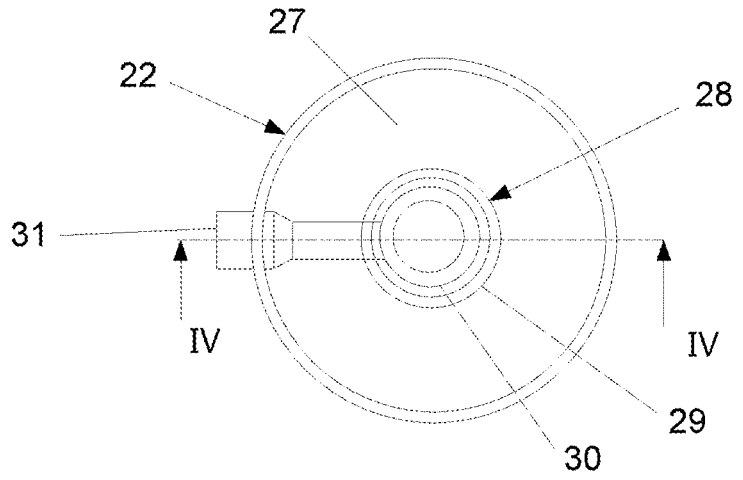
FIG. 14 is an end view of a second transition flow element with a flow control element provided therein, in a first state.
Figure 15:
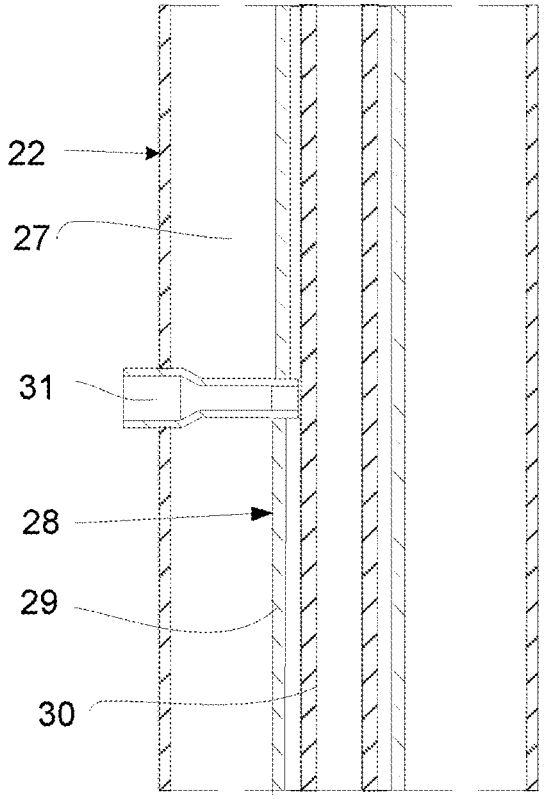
FIG. 15 is a cross-section according to XIV-XIV in FIG. 14.
Figure 16:
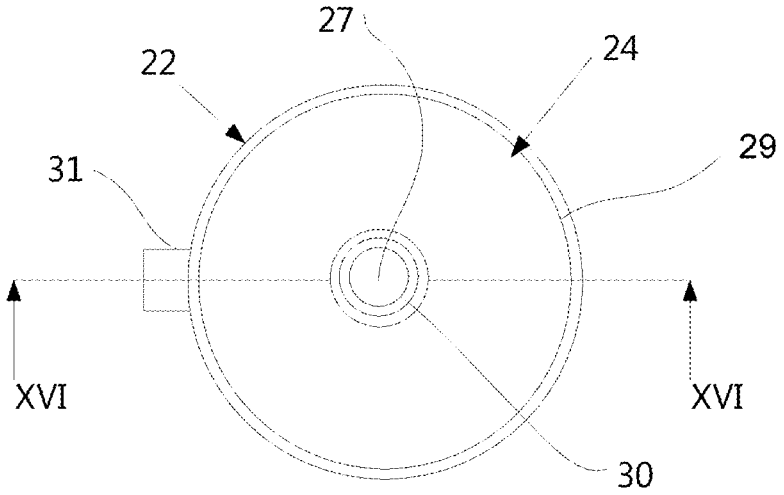
FIG. 16 is an end view of the second transition flow element, with a flow control element provided therein in a second state.
Figure 17:
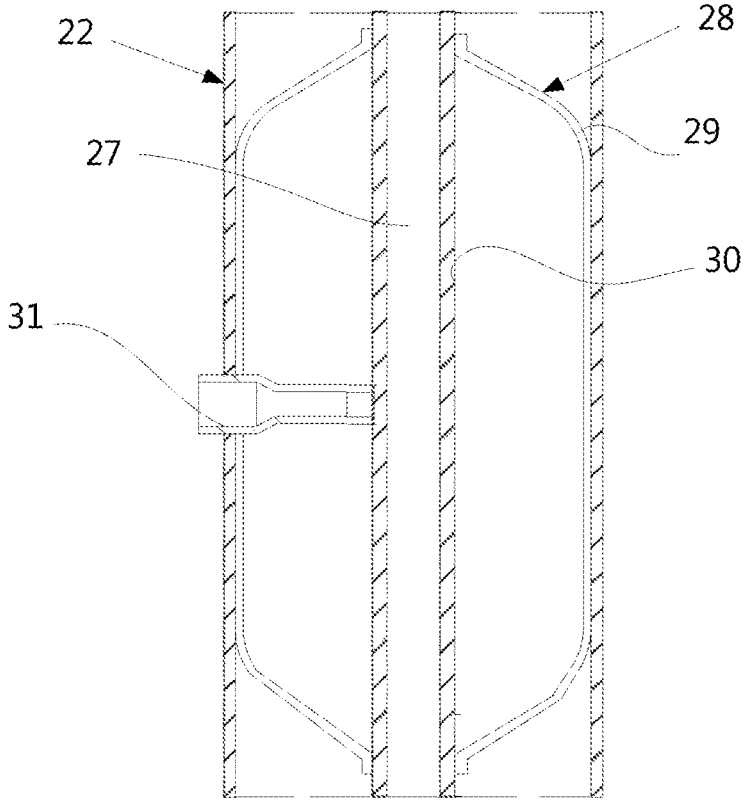
FIG. 17 is a cross-section according to XVI-XVI in FIG. 16.

In FIGS. 14 and 15, the pressure in the channel 27 is high enough to compress the collapsible body 29 such that it does not remarkably reduce the cross-sectional area and the volume of the channel 27. In FIGS. 16 and 17, the pressure in the channel 27 is reduced to such an extent that the gas pressure inside the collapsible body 29 expands the latter such that it fills up the volume between the non-flexible tube 30 and the inner periphery of the transition flow element 22. The pressure inside the collapsible body 29 is set such that this state typically will be obtained as the working piston 10 approaches its upper dead point during the operation cycle of the engine. The channel 27 inside the non-flexible tube will, however, enable further working gas to pass through the transition flow element, also when the collapsible body 29 is fully expanded.

When the flow control element 28 is in a position in which it allows maximum passage of working gas, i.e. when it is in its least voluminous state, the cross-sectional area of the channel 27 defined by second transition flow element 22 at any point along the length of the channel 27 is within the range of the medium cross section area of the working gas channel +/−10%, preferably within the range of the medium cross section area of the working gas channel +/−5%.

Between the third heat exchanger 20 and the second transition flow element 22 there is provided a collecting element 44 that defines a channel that has an annular inlet which is connected to the end of the third heat exchanger 20 and that has a circular outlet which is connected to the adjacent end of the channel 27 defined by the second transition flow element. The collecting element 44 will, as a consequence of its design have a larger cross-sectional area than the medium cross-sectional area of the working gas channel, but it only occupies less than 1%, preferably less than 0.5%, of the total length of the working gas channel, and therefore only has a minor effect on the flow losses.

The working gas channel is comprised by the channels defined by the following components (with percentage of total length of working gas channel):

channel defined by each tube of first heat exchanger 16: 25-50% channel defined by first transition flow element 21: 2-10% channel defined by second heat exchanger 17: 2-10% channel defined by third heat exchanger 20: 5-15% channel defined by second transition flow element 22: 20-40% collecting element 44: <1%

According to an example, the cross-sectional area over the entire working gas channel may be constant within +/−10% in order to obtain a desired laminar flow. The entire working gas channel may extend from the hot chamber at the displacer cylinder head to the second part of the working chamber at the working cylinder head.

The foregoing description of the examples has been furnished for illustrative and descriptive purposes. It is not intended to be exhaustive, or to limit the examples to the variants described. Many modifications and variations will obviously be apparent to one skilled in the art. The examples have been chosen and described in order to best explicate principles and practical applications, and to thereby enable one skilled in the art to understand the examples in terms of its various examples and with the various modifications that are applicable to its intended use. The components and features specified above may, within the framework of the examples, be combined between different examples specified.

What is claimed is:

1. A stirling engine comprising:

a crank case with a crank shaft arranged therein, a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston, a working cylinder defining a working cylinder chamber with a reciprocatingly arranged working piston therein, said working piston being connected to said crank shaft via a connecting rod extending through a first end of the working cylinder, a heater, arranged at a second end of said displacer cylinder opposite to said first end and configured to heat a working gas which is present in the hot chamber of the displacer cylinder and in fluid communication with the working cylinder chamber through a working gas channel which comprises a first heat exchanger extending from a head of the displacer cylinder into the heater, a second heat exchanger formed by a regenerator arranged outside the heater, a third heat exchanger formed by a cooler arranged between the regenerator and the working cylinder chamber, and an inter heat exchanger transition flow element provided between and connecting the first heat exchanger and the second heat exchanger, wherein said inter heat exchanger transition flow element comprises a plurality of channels that each has an inlet opening having a shape and cross sectional area corresponding to the shape and cross-sectional area of the channel of a tube of the first heat exchanger to which it is connected, and an outlet opening facing said second heat exchanger, and that along at least 80% of the length thereof the channels of the inter heat exchanger transition flow element have a total cross sectional area along which is within the range of the medium cross section area of the working gas channel +/−10%, and wherein, at any point along the working gas channel, as seen cross wise to an assumed working gas flow direction through the working gas channel, the cross section area of the working gas channel defined by the first, second and third heat exchangers is within the range of the medium cross section area of the working gas channel +/−10%.

2. The stirling engine according to claim 1, wherein at any point along the working gas channel, as seen cross wise to an assumed working gas flow direction through the working gas channel, the cross section area of the working gas channel defined by the first, second and third heat exchangers is within the range of the medium cross section area of the working gas channel +/−5%.

3. The stirling engine according to claim 1, wherein along at least 95% of the total length of the working gas channel, the cross section area of the working gas channel is within the range of the medium cross section area of the working gas channel +/−5%.

4. The stirling engine according to claim 1, wherein the first heat exchanger comprises a plurality of tubes, wherein the cross-section area of said working gas channel at any predetermined point along the tubes is the total cross-section area of the individual channels at that point along the channels defined by the tubes.

5. The stirling engine according to claim 1, wherein the regenerator comprises an annular body of a metal foam.

6. The stirling engine according to claim 1, wherein the third heat exchanger comprises a tubular metallic body provided with a plurality of first channels extending through said metallic body for the conducting of the working gas and at least one second cooling channel for the conducting of a cooling fluid through said cooling channel.

7. The stirling engine according to claim 1, wherein along at least 99%, of the total length of the working gas channel, the cross section area of the working gas channel is within the range of the medium cross section area of the working gas channel +/−5%.

8. The stirling engine according to claim 1, wherein said plurality of channels along at least 80% of the length thereof, have a total cross sectional area along which is within the range of the medium cross section area of the working gas channel +/−5%.

9. A stirling engine comprising:

a crank case with a crank shaft arranged therein, a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston, a working cylinder defining a working cylinder chamber with a reciprocatingly arranged working piston therein, said working piston being connected to said crank shaft via a connecting rod extending through a first end of the working cylinder, a heater, arranged at a second end of said displacer cylinder opposite to said first end and configured to heat a working gas which is present in the hot chamber of the displacer cylinder and in fluid communication with the working cylinder chamber through a working gas channel which comprises a first heat exchanger extending from a head of the displacer cylinder into the heater, a second heat exchanger formed by a regenerator arranged outside the heater, and a third heat exchanger formed by a cooler arranged between the regenerator and the working cylinder chamber, and a working cylinder transition flow element provided between the third heat exchanger and the working cylinder, wherein at any point along the length thereof, a channel defined by the working cylinder transition flow element has a total cross sectional area which is within the range of the medium cross section area of the working gas channel +/−10%.

10. The stirling engine according to claim 9, wherein the working cylinder transition flow element is provided with a flow controller configured to control the cross-sectional area of the channel defined by the working cylinder transition flow element, and wherein the cross-sectional area of the working gas channel, at any point along said channel defined by the working cylinder transition flow element, is within the range of the medium cross-sectional area of the working gas channel +/−10% when the flow controller is in a position in which it allows maximum passage of working gas.

11. The stirling engine according to claim 9, wherein at any point along the length of the working cylinder transition flow element, the channel defined by the working cylinder transition flow element has a total cross sectional area which is within the range of the medium cross section area of the working gas channel +/−5%.

12. The stirling engine according to claim 9, wherein at any point along the working gas channel, as seen cross wise to an assumed working gas flow direction through the working gas channel, the cross section area of the working gas channel defined by the first, second and third heat exchangers is within the range of the medium cross section area of the working gas channel +/−5%.

13. The stirling engine according to claim 9, wherein along at least 95% of the total length of the working gas channel, the cross section area of the working gas channel is within the range of the medium cross section area of the working gas channel +/−5%.

14. The stirling engine according to claim 9, wherein the first heat exchanger comprises a plurality of tubes, wherein the cross-section area of said working gas channel at any predetermined point along the tubes is the total cross-section area of the individual channels at that point along the channels defined by the tubes.

15. The stirling engine according to claim 9, wherein the regenerator comprises an annular body of a metal foam.

16. The stirling engine according to claim 9, wherein the third heat exchanger comprises a tubular metallic body provided with a plurality of first channels extending through said metallic body for the conducting of the working gas and at least one second cooling channel for the conducting of a cooling fluid through said cooling channel.

* * * * *